United States Patent [19]

Hogan

[11] 4,340,007

[45] Jul. 20, 1982

[54] PORTABLE LOCKING AND ALARM SYSTEM

[76] Inventor: Paul Hogan, 26 Buckwalter Rd., Phoenixville, Pa. 19460

[21] Appl. No.: 141,385

[22] Filed: Apr. 18, 1980

[51] Int. Cl.[3] ..... G08B 13/12; G08B 13/22

[52] U.S. Cl. ..... 116/81; 116/33; 340/63; 340/404

[58] Field of Search ..... 116/33, 77, 100, DIG. 44, 116/DIG. 7, 8, 81, 88, 94, 85; 340/63, 404, 568, 384

[56] References Cited

U.S. PATENT DOCUMENTS

| | | | |
|---|---|---|---|
| 2,878,774 | 3/1959 | Carroll | 116/DIG. 44 |
| 3,451,369 | 6/1969 | Leve | 116/94 |
| 3,725,886 | 4/1973 | Marks | 340/404 |
| 3,754,224 | 8/1973 | Roy | 116/33 |
| 3,781,861 | 12/1973 | Adler | 116/33 |
| 3,824,540 | 7/1974 | Smith | 116/33 |
| 3,866,205 | 2/1975 | Payne | 116/33 |

FOREIGN PATENT DOCUMENTS

| | | | |
|---|---|---|---|
| 395789 | 3/1909 | France | 116/88 |

*Primary Examiner*—Kyle L. Howell
*Assistant Examiner*—Denis E. Corr
*Attorney, Agent, or Firm*—Eugene E. Renz, Jr.

[57] ABSTRACT

A portable locking and alarm system for securing objects to a stationary member comprising an enclosed casing and a flexible cable secured at one end to the casing by a conventional key-type lock and secured at its opposite end to an audio alarm actuating system internally of the casing. The flexible cable includes an outer hollow casing and a relatively thin elongated actuating core. The audio alarm actuating system includes a spring biased hammer secured to the core of the cable and normally spaced in an unarmed position relative to a piercing or actuating pin for puncturing the diaphragm at the discharge end of a $CO_2$ cylinder. As long as the cable and core member remain intact, the hammer remains in an unarmed position and the audio alarm system is dormant. However, if the cable is severed or the casing tampered with, the piercing pin is actuated by the hammer or a pivotally mounted member internally of the casing to puncture the diaphragm whereby the $CO_2$ cylinder discharges through a conduit to a horn-like alarm. The system thus acts as a deterrent to would-be thieves since it ensures actuation of the audio alarm when someone tampers with either the cable or casing.

3 Claims, 6 Drawing Figures

PORTABLE LOCKING AND ALARM SYSTEM

BACKGROUND OF THE INVENTION

The present invention relates to alarm-type locking systems particularly adapted for use on vehicles such as bicycles and motorcycles. Vehicles of this type are easy prey for thieves unless they are securely locked to a stationary member, such as a post or stand, when they are not in use. Accordingly, conventional locking arrangements for securing bicycles or motorcycles to a stationary member when they are not in use typically comprise an elongated chain or cable which loops around the frame of the bicycle or motorcycle and the stationary post or stand. The end of the cable or chain is then locked with a padlock of conventional design. These locking devices have not proved entirely successful in preventing thefts. Heavy duty bolt cutters can easily be employed to cut through high tensile steel and cable lock shafts. Accordingly, it is an object of the present invention to provide a locking system which is tamper proof to the extent that tampering by cutting the cable or prying the casing open actuates a self-contained audible alarm system. The effect of this system will be to surprise and frighten the would-be thief and discourage him from completing the theft because of the audio alarm which would attract attention to him. The present invention, therefore, can effectively serve as a deterrent, stopping the thief short of completing the act of confiscating the bicycle or motorcycle.

Security alarm systems of this general type are not new per se. For example, a similar system is shown in U.S. Pat. No. 3,754,224 issued Aug. 21, 1973 to Willhoe R. Roy et al entitled SECURITY ALARM ACTUATING DEVICE. This system is particularly adapted for sensing unauthorized opening of a gate or the like and includes an electrical series loop incorporated into a mechanical structure for locking relatively movable members of a gate. The Roy system is rather complex and comprises a number of interconnected cooperating elements including a coaxial cable 20 secured to a box 14 mounted on one of the gate members 12, a casing 24 housing a switch operating element 28 also secured to the post 12 and a conventional padlock 42 having a shackle 40. The cable 20 passes through an opening in the bottom of the pin 28 and there mechanically secured in place. Two registered openings 36 and 38 and the pin 28 and the frame 24 may be aligned so as to receive the shackle 40 of the padlock 42. The frame includes a fixedly mounted, normally opened single throw switch 44 having an operating member in the form of a plunger 46 and spring biased outwardly so that when it is depressed the open switch contacts will be closed. With the gate closed and the post 10 and 12 juxtaposed, cable 20 is passed around the post 10 and 12 and the rod 28 is inserted in the frame 24 and positioned to receive the shackle 40 of the lock 42. Engagement of the upper end of the rod 28 with the plunger 46 closes the switch 44 thereby presenting a closed circuit to the terminals 52. Now if the lock 42 is removed, or the cable is cut, an open circuit is presented to the terminals 52 which activates the alarm system.

SUMMARY OF THE INVENTION

By contrast the present invention utilizes but a single cable locked by an ordinary keeper lock at one end to the casing and at its other end secured permanently to the casing and connected by operative means to the audio signal producing device. The core of the cable mounts a spring biased hammer. The hammer is normally spaced from an actuating pin for an audio alarm actuating member. Thus, if the cable is cut, the spring can freely actuate the hammer to engage the audio alarm since the core is severed and the normal force holding the hammer in a raised position is released. The casing also includes means for actuating the audio alarm in the event of tampering with the casing. Thus the present invention provides a tamper proof alarm system to the extent that cutting the cable or tampering with the casing ensures actuation of the audio alarm as a deterrent to further removal of the property by the thief.

DESCRIPTION OF THE DRAWINGS

These and other objects of the present invention and the various features and details of the operation and construction thereof are hereinafter more fully set forth with reference to the accompanying drawings wherein:

FIG. 1 is a side elevational view showing the portable locking device with an alarm system for securing a bicycle to a stationary post or the like;

DESCRIPTION OF THE PREFERRED EMBODIMENTS

Figure 1:
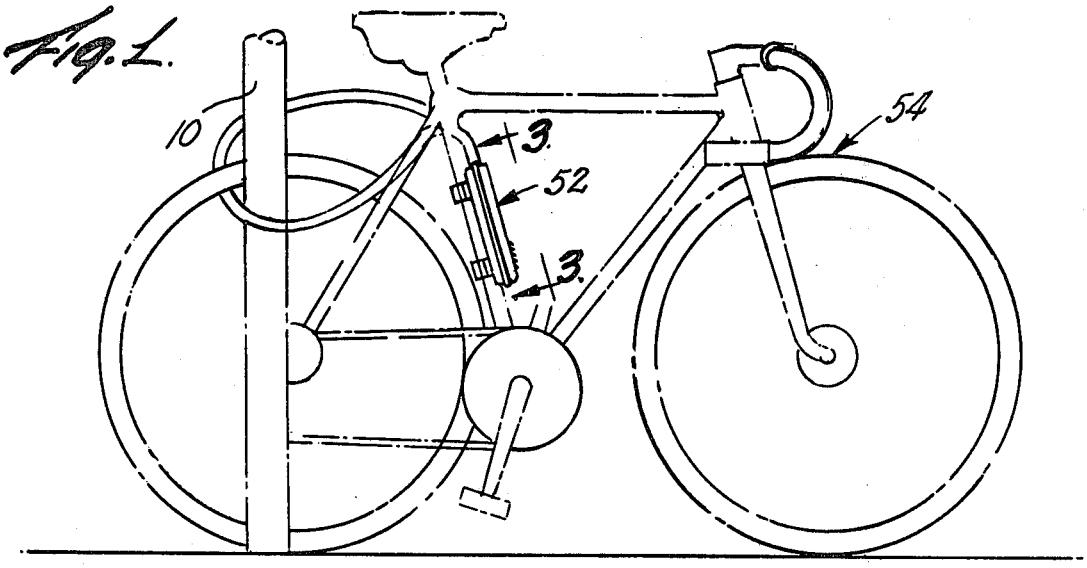
Figure 2:
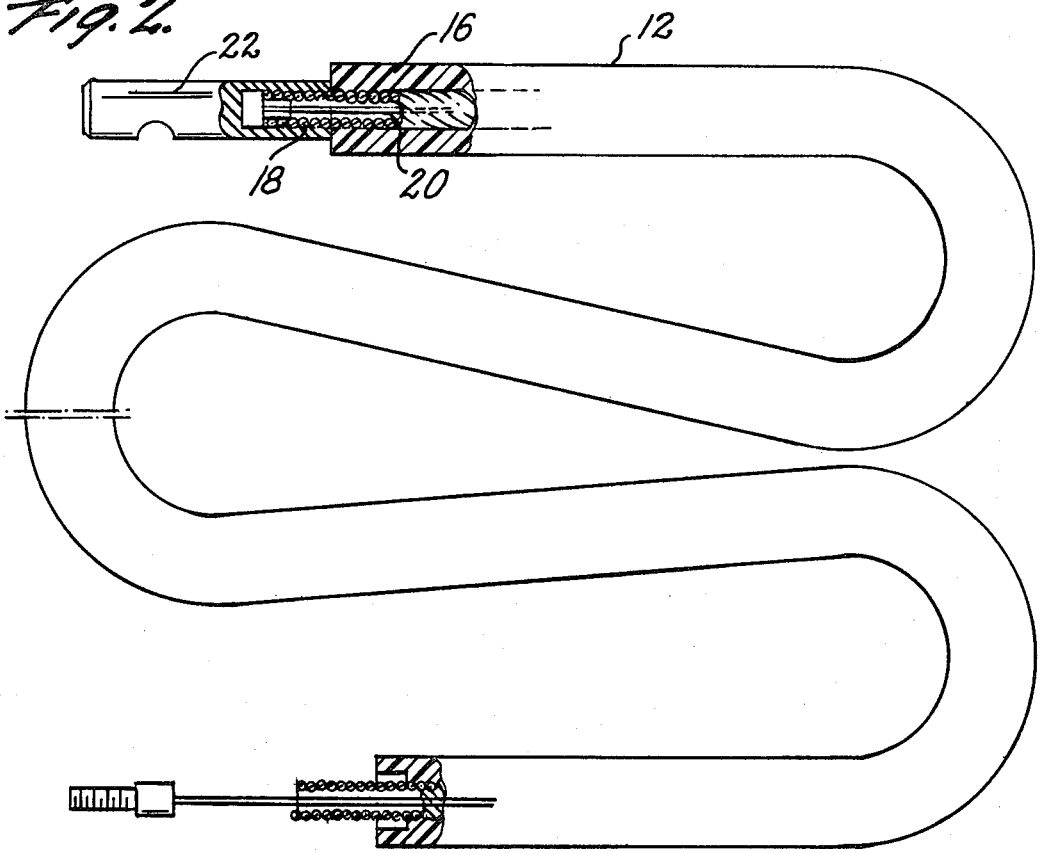
FIG. 2 is an enlarged plan view partly in section showing the details of the cable.
Figure 3:
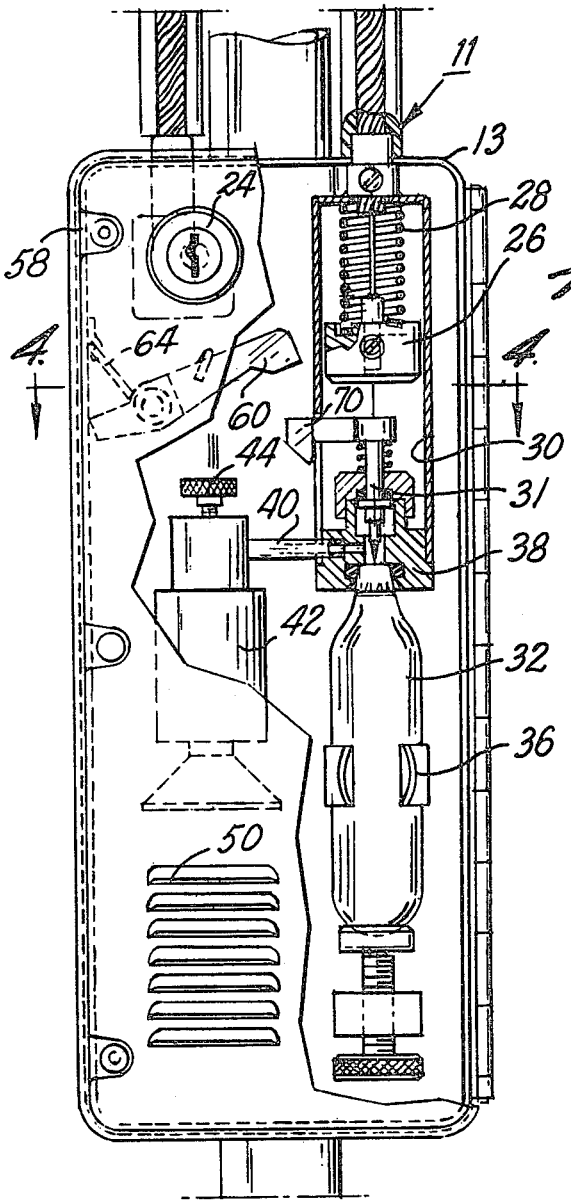
FIG. 3 is an enlarged plan view with parts broken away of the casing and showing engagement of the terminal ends of the cable to the internal parts of the casing.

Referring now to the drawings, and particularly to FIGS. 1 and 2 thereof, the locking system of the present invention is particularly adapted for securing parked vehicles such as bicycles and motorcycles to a stationary stand or post 10. The locking system generally designated by the numeral 11 includes an elongated flexible cable 12 adapted to loop through the wheel and over the stationary post and be secured at its outer terminal ends to an alarm casing 13 of the system 11. The cable as illustrated has a flexible sheathing 16 made of a resilient material, such as rubber or Teflon, and a central metallic hollow core member 18 of braided wire and a relatively thin elongated actuating core 20 also made of metal. One end of the core 20 mounts a male locking member 22 secured in the casing by a conventional key-operated keeper or lock 24. The braided wire core is fixed to the casing as illustrated in FIG. 3. Note that the slender wire core 20 projects beyond the end of the braided wire casing and mounts a hammer 26. A compression spring 28 circumscribes the extended portion of the core 20 and abuts the inner face of the hammer 26. The hammer 26, as illustrated, is mounted in a chamber 30 within the casing at a predetermined height above a piercing pin 31 located above a $CO_2$ cylinder 32 which has a puncturable diaphragm 34. Note that the piercing pin 31 is normally spring biased to a raised position where the puncturing point is spaced above the diaphragm 34 of the $CO_2$ cylinder 32. The $CO_2$ cylinder 32 is mounted in a fixed position by means of a clamp-like U-shaped bracket 36. The fitting 38 surrounding the discharge end of the $CO_2$ cylinder includes a conduit 40 connecting with a gas operated alarm horn 42. The horn 42 has a metering valve 44 which selectively adjusts the opening from the conduit so that the pitch and duration of the alarm signal can be selectively controlled.

Figure 5:
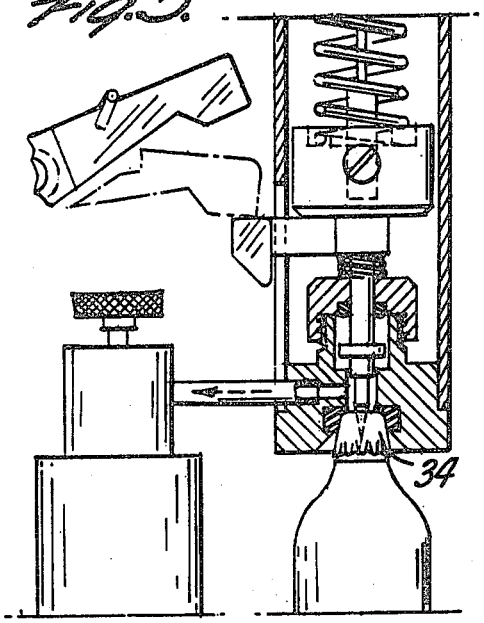
FIG. 5 is an enlarged fragmentary sectional view showing the cable hammer actuated to an operative armed alarm arming position.

Considering now the operation of the system described and assume that the parts are in the position illustrated in FIGS. 1 and 3 in a locked condition. Now if the cable 12 is severed, the central actuating core 20 is cut in two whereby the hammer 26 is driven by the compression spring 28 to engage the blunt head of the piercing pin 31 and drive it downwardly against the bias of the piercing pin spring to the position shown in FIG. 5. In this manner the diaphragm 34 is punctured and the $CO_2$ gas is released and directed through the conduit 40 to operate the alarm horn 42. Note that the casing has louvered openings 50 adjacent the discharge end of the horn to permit sounding of the horn outside the casing.

Figure 4:
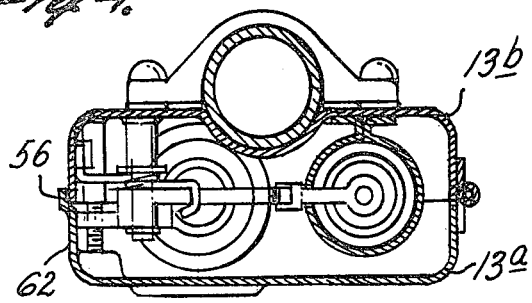
FIG. 4 is a sectional view taken on lines 4—4 of FIG. 3.

As illustrated, the casing 13 is mounted securely to one of the frame members 52 of the bicycle 54 and has two sections 13*a*, 13*b* which are pivotally mounted about a longitudinal side axis. The casing sections have an overlapping flange portion 56 on the side opposite the hinge connection and are secured together by three screw-type fasteners 58. As illustrated in FIGS. 3 and 4, a pivotally mounted hammer 60 is supported in the casing for pivotal movement about a predetermined axis. The hammer is normally maintained in a raised position by engagement against the sidewall 62 of one of the casing sections 13*a*. An over center leaf spring 64 is mounted on the hammer 60 to pivot it downwardly in the event that the inner edge of the hammer is freed to rotate, which can occur when the casing sections are separated, for example, by an intruder trying to pry the casing open. In this event, the spring 64 pivots the hammer 60 downwardly to engage an extended portion 70 of the piercing pin 31 for the $CO_2$ cylinder. Thus, the system operates to not only emit a signal if the cable is severed, but also in the event of tampering with the casing.

Figure 6:
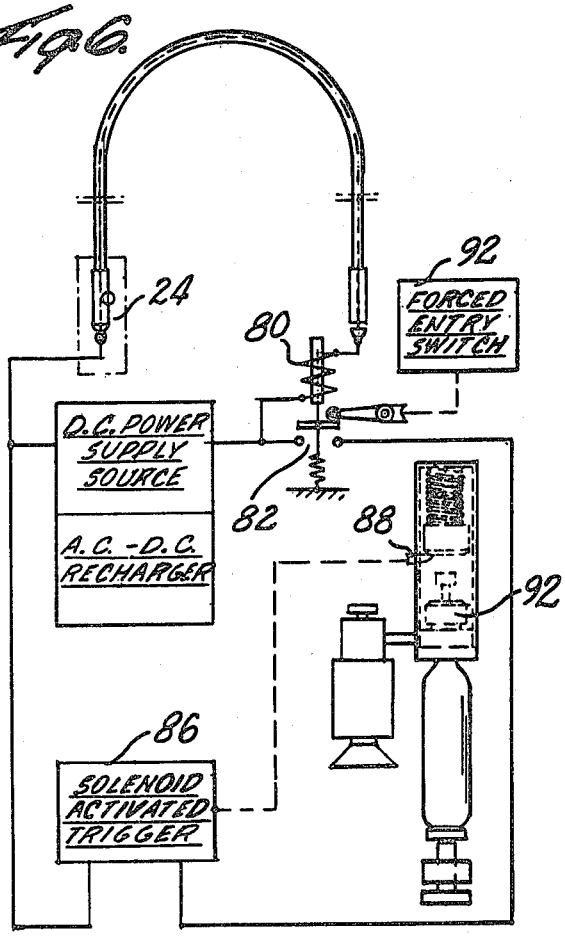
FIG. 6 is a schematic view of an alternate portable locking alarm system in accordance with the present invention.

FIG. 6 illustrates a modified form of the lock-alarm system in accordance with the present invention. The overall operation of the system is essentially the same as that described above. However, in this instance, the system is electrically operated whereas in the preferred embodiment, the system is entirely mechanical. To this end, the circuit includes the wire core 20, a battery operated electrical solenoid 80 which when energized normally retains switch 82 in an open position. In this position the alarm is dormant. Note that in this position the circuit through the key operated keeper 24 is closed except that the switch 82 is open. Now if the cable is severed, the circuit is interrupted, solenoid 80 is deenergized and the switch 82 is actuated to a closed position to energize a secondary solenoid 86 which in turn then operates the trigger mechanism 88 for the alarm system in much the same manner as illustrated in FIG. 3. Thus, the solenoid activated trigger 88 normally retains the spring biased hammer 90 in a raised position and when it is activated in the manner described above, the trigger releases and the hammer 90 drives the piercing pin downwardly to puncture the diaphragm for the $CO_2$ cylinder to actuate the audio alarm.

The system also includes a forced entry switch 92 suitably mounted in the casing to function in much the same manner as the pivotally mounted hammer 60 so that if the casing is forceably broken into, the forced entry switch is actuated to close the switch 82, activate solenoid 86 to thereby release trigger 90 and permit spring biased hammer 90 to descend and activate the piercing pin to puncture the diaphragm of the pressurized fluid source.

While particular embodiments of the present invention have been illustrated and described herein, it is not intended to limit the invention and changes and modifications may be made therein within the scope of the following claims. For example, even though the system has been illustrated and described in connection with securing parked vehicles such as bicycles or motorcycles to a stationary stand, the combination lock and alarm system has many other useful applications. For example, it can be utilized as a combination lock and alarm for tool boxes on construction sites or as a lock for a barn or other type of outbuilding or as an added door or window lock for inner city apartments or dwellings. It can be utilized in the manner described above as a combination lock and alarm for the steering wheel of a car or to secure a chain saw. In general, therefore, the combination lock and alarm can be used in many applications which employs a hasp or columns or rings which hold an object in place. It is also noted that the $CO_2$ cartridge is a standard off-the-shelf item.

What is claimed is:

1. A combination lock and alarm assembly comprising a casing, an elongated flexible cable including a core member detachably secured at one end to the casing by locking means and securely mounted at its other end to the casing, an alarm system in the casing including a reservoir for a fluid under pressure normally sealed by a diaphragm, means adapted to pierce the diaphragm in response to predetermined tampering conditions, a fluid actuated audio alarm and means connecting said audio alarm to said pressurized fluid reservoir whereby upon puncturing of said diaphragm, pressurized fluid is discharged to actuate said audio alarm, said casing comprising two pivotally mounted sections and including a hammer pivotally mounted in one of said sections and engageable with the other of said sections and including spring biasing means operable to pivot said hammer upon disengagement from said other casing section to actuate said piercing member.

2. A combination lock and alarm system as claimed in claim 1 including an elongated cylindrical chamber, a piston secured to the core member mounted in said chamber and biasing means normally urging the piston in a predetermined direction in said chamber, said pressurized fluid reservoir mounted at the bottom of said cylindrical chamber and a spring biased piercing element mounted between said hammer and said diaphragm, said hammer normally spaced from said piercing member and actuatable downwardly to engage said piercing member to puncture said diaphragm when said cable core is severed.

3. A combination lock and alarm system as claimed in claim 2 including conduit means connecting said chamber with said audio alarm member.

* * * * *